US005168937A

United States Patent [19]

Hamner

[11] Patent Number: 5,168,937

[45] Date of Patent: Dec. 8, 1992

[54] DRILL FEED CONTROL UTILIZING A VARIABLE OVERCENTER VALVE

[75] Inventor: Jeffrey W. Hamner, Allen, Tex.

[73] Assignee: Ingersoll-Rand Company, Woodcliff Lake, N.J.

[21] Appl. No.: 769,654

[22] Filed: Oct. 2, 1991

[51] Int. Cl.[5] ..... E21B 19/08

[52] U.S. Cl. ..... 173/4; 173/9; 91/420; 60/460

[58] Field of Search ..... 173/2, 4, 9, 14, 18, 173/19, 152, 158, 165, 166; 91/420; 60/460

[56] References Cited

U.S. PATENT DOCUMENTS

| | | | |
|---|---|---|---|
| 2,790,340 | 4/1957 | Cross | 173/4 |
| 3,648,783 | 3/1972 | Lackey | 173/4 |
| 3,659,655 | 5/1972 | Gyongyosi | 173/4 |
| 4,440,236 | 4/1984 | Shiihara et al. | 173/9 |
| 4,711,090 | 12/1987 | Hartiala et al. | 173/9 |
| 4,732,076 | 3/1988 | Ewald | 60/460 |
| 4,953,639 | 9/1990 | Hamner et al. | 175/203 |

*Primary Examiner*—Douglas D. Watts
*Assistant Examiner*—Scott A. Smith
*Attorney, Agent, or Firm*—Glenn B. Foster; John J. Selko

[57] ABSTRACT

An apparatus includes a feed cylinder having a first end port and a second end port. A feed cylinder is located within the feed cylinder and is movable in a drive direction in response to fluid pressure applied to the first end port, and is movable in a return direction in response to fluid pressure applied to the second end port. A feed pump selectively displaces fluid between the first and the second end ports. A variable overcenter device controls fluid pressure offset, independent of the feed pump, between the first end port and the second end port. An adjustment device automatically adjusts the variable overcenter device during travel of the feed cylinder in the drive direction to a value corresponding to an amount of force required to displace the feed cylinder in the return direction. The variable overcenter device may be either microprocessor based or mechanically based including an accumulator reservoir which builds to a certain pressure based upon the amount of weight of the drill string when the feed cylinder was last displaced in the return direction.

7 Claims, 7 Drawing Sheets

DRILL FEED CONTROL UTILIZING A VARIABLE OVERCENTER VALVE

BACKGROUND OF THE INVENTION

This invention relates generally to a drill feed control system and more particularly to an automatic variable control for setting the bias of an overcenter valve.

A drill feed force control system for a hydraulic drilling machine is used to limit the force applied to the material being drilled as the drilling device is advancing. The control system must be adjustable so that the drilling force may be altered depending upon the material which is being drilled. The control means must be able to accommodate drill strings of different weights, while allowing drilling force to remain approximately the same.

Drill feed advance is generally accomplished by providing the appropriate oil supply and return to a hydraulic motor or cylinder attached to a mechanical drill feed apparatus. Drill feed force control is generally accomplished by modifying the hydraulic pressures in the drive and the return oil conduits connected to the feed cylinders or motors.

Increasing return oil pressure biases the return chamber of the feed cylinder which limits the application of the feed force. This return bias is necessary to restrict the drill string from advancing on its own due to the influence of its own weight. The return bias is often referred to as "holdback". Increasing the pressure to the drive chamber adds bias to the drill string in the drive direction and acts to counteract the holdback force.

The amount of drive force and holdback force required for a specific drilling operation follow two basic rules. First, there must be enough holdback force available to hold up the weight of the drill string whenever the drill feed force control is at its minimum value. Since the drill weight changes as drill lengths are added and removed, the holdback force must be adjusted accordingly. Alternatively, the holdback device may be set to a fixed setting high enough to hold back the total anticipated string weight and the drive force adjusted to produce the desired drill feed force. The second rule is that the drill feed force must be predictable and repeatable when drilling. This is true especially in down hole hammer drilling operations where improper drill feed forces can result in damage to the drill components.

Drill machines in use today typically require one or two adjustable pressure controls so that the drill operator can control the drive and the holdback bias according to any one of the following three methods. The first method is to set the minimum holdback pressure at a fixed level sufficient to hold back the entire maximum drill string weight and adjust drive pressure to achieve the desired drill feed force. The second method is to set the maximum drive pressure at its minimum level and adjust the holdback pressure to achieve the desired drill feed force using only the available weight of the drill string to apply the drill feed force. The third method involves adjusting both the drive and holdback pressures to suit the immediate requirement for the drill feed force.

In all three methods, using the prior art feed control systems, the drill operator must know the relation between the drive force, holdback force and drill weight to accurately maintain the desired drill feed force. If the drill operator does not know this relationship the drill force cannot be predicted.

Even though experience in drilling in a particular area, gauges which indicate torque applied to the drill head and even the drilling sound of the drill head produced during the drilling action can provide indications as to the drill feed force, these methods are not precise and depend upon operator expertise.

The foregoing illustrates limitations known to exist in present drill feed force control systems used in drilling systems. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus comprising a feed cylinder having a first end port and a second end port. The feed cylinder is movable in a drive direction in response to fluid pressure applied to the first end port and movable in a return direction in response to fluid pressure applied to the second end port. A feed pump alternately applies fluid pressure to the first or the second end port. A variable overcenter valve controls relative fluid pressure between the second end port and the feed pump during application of fluid pressure by the feed pump to the first end port. An adjustment device adjusts the variable overcenter means during each application of fluid pressure to the first end port to a fluid pressure corresponding to the fluid pressure last applied to the second end port.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
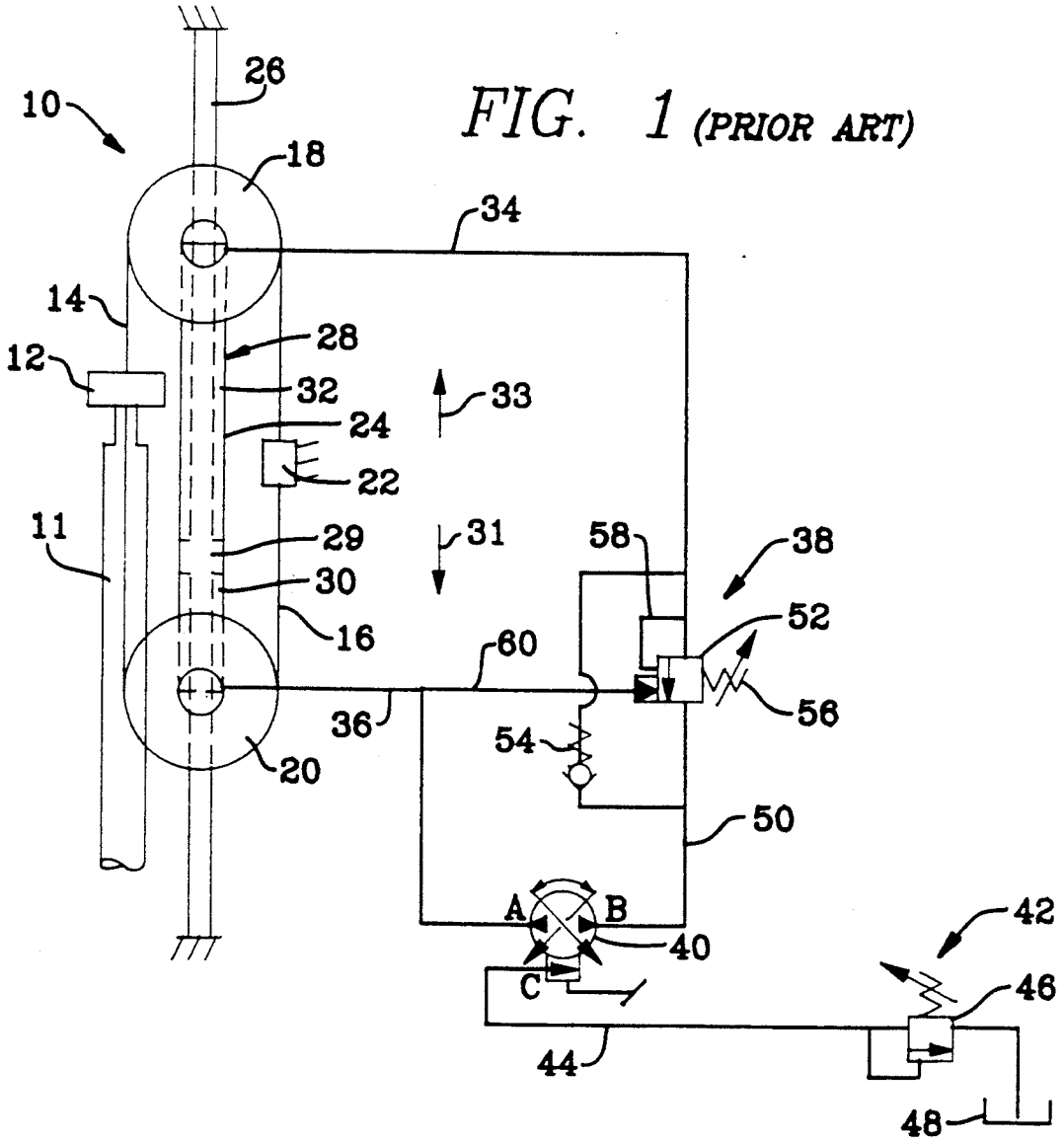
FIG. 1 (PRIOR ART)
FIG. 1 is a schematic view illustrating a drill feed control utilizing an overcenter valve of the prior art.

In this disclosure, similar items which perform identical functions in different embodiments are provided with identical reference characters.

Structural Description

Figure 3:
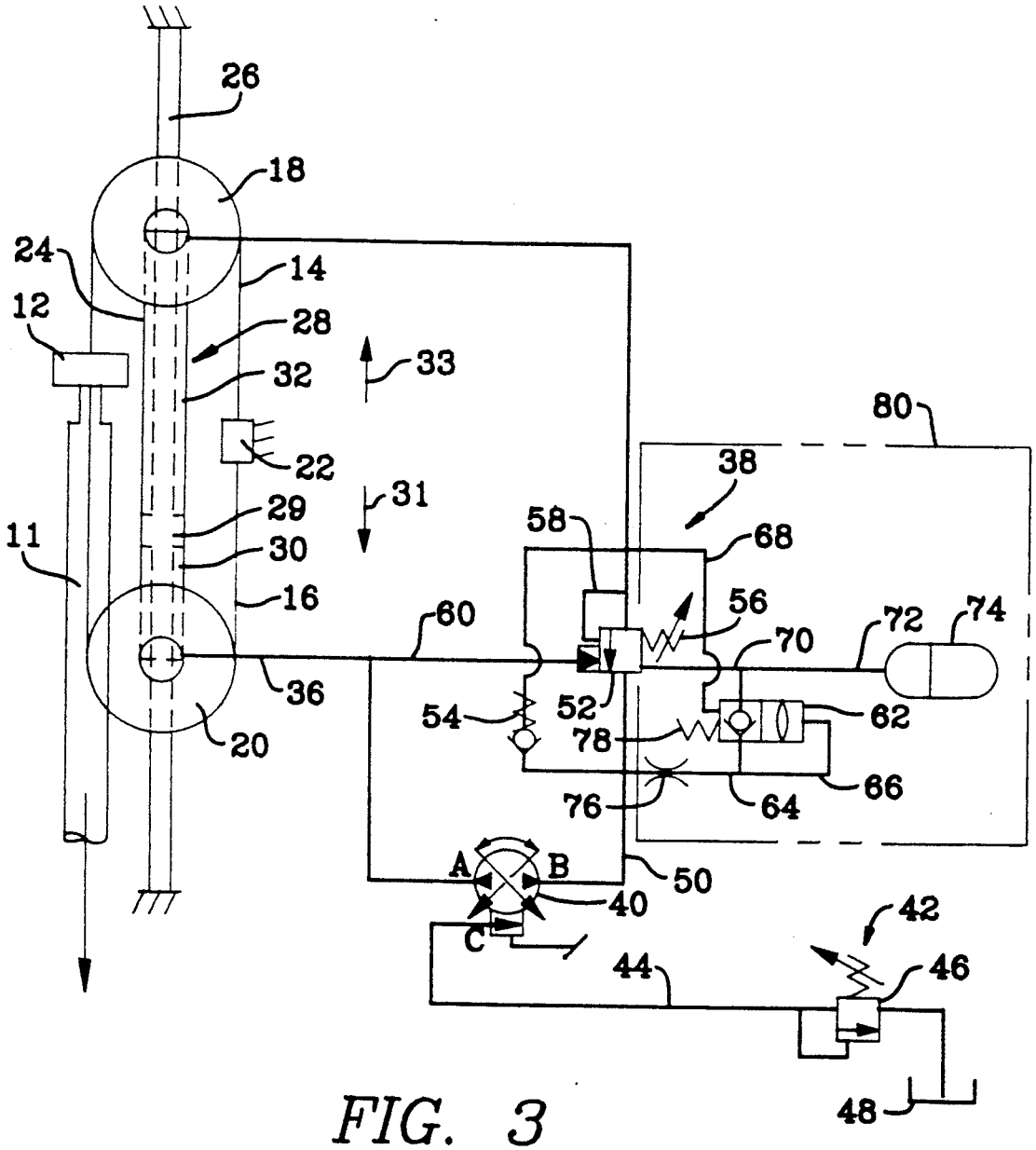
FIG. 3 is a schematic view illustrating a drill feed control utilizing one embodiment of variable overcenter valve of the present invention involving an accumulator reservoir.
Figure 5:
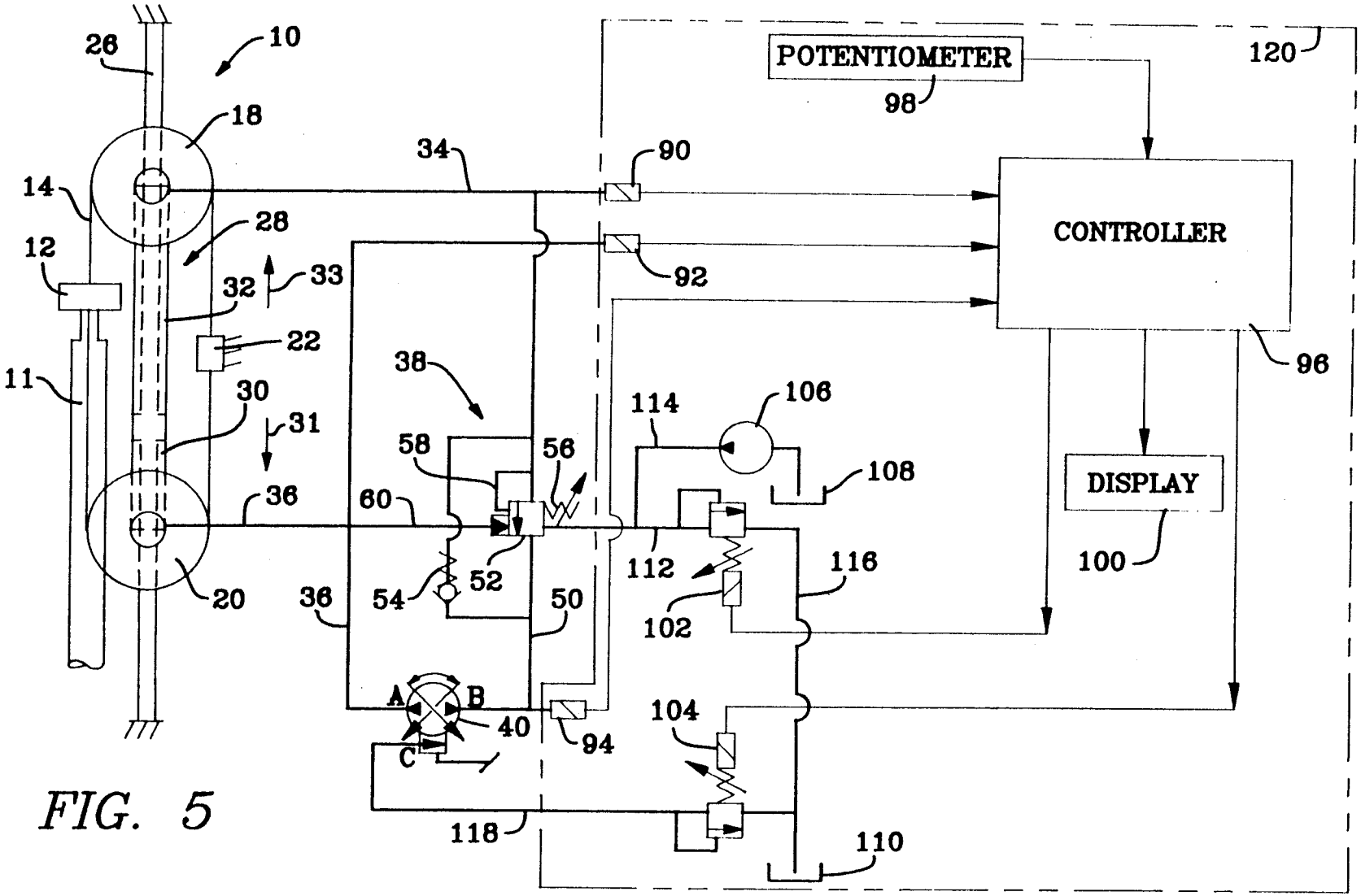
FIG. 5 is a schematic view illustrating an embodiment of drill feed control utilizing another embodiment of variable overcenter valve of the present invention including a computerized controller.
Figure 8:
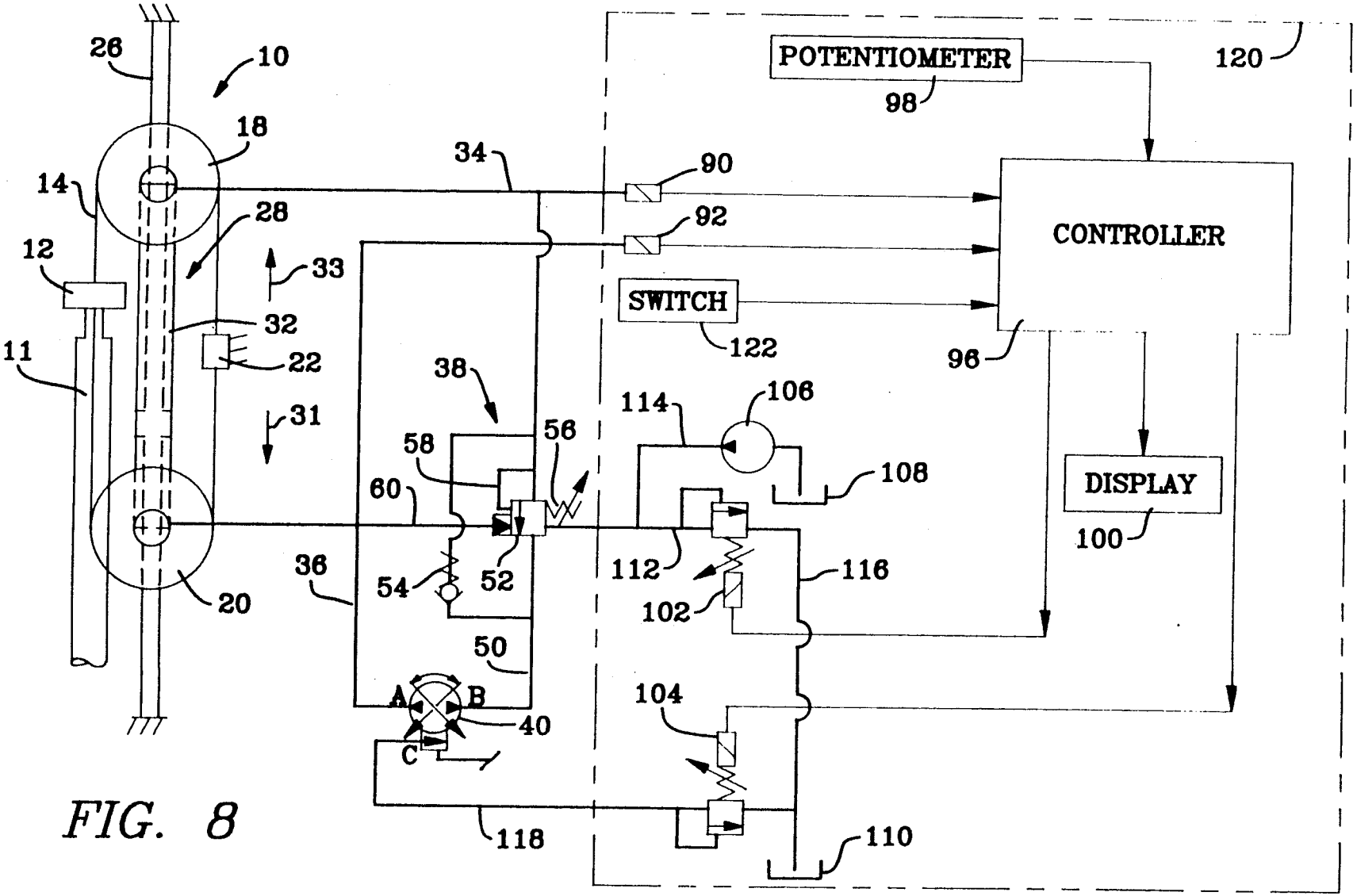
FIG. 8 is a schematic view illustrating an embodiment of drill feed control utilizing yet another embodiment of variable overcenter valve of the present invention including a controller with different inputs.

FIG. 1 illustrates a feed system for a drilling apparatus 10 of the prior art. The elements contained in the FIG. 1 prior art embodiment are also contained in the FIGS. 3, 5 and 8 present invention embodiments. The elements of FIG. 1 are described first followed by the distinctions between the present invention and the prior art.

The drilling apparatus includes a drill string 11. A rotary head 12 provides rotary motion to the drill string 11. Cables 14 and 16 are affixed to the rotary head 12, and extend around pulleys 18, 20 respectively. The cables 14 and 16 are fixed at an opposite end to fixed point 22. The pulleys 18 and 20 are fixed to the top and the bottom portion of a piston barrel 24. The piston barrel 24 encases a fixed rod guide 26, which together forms a feed cylinder 28. The fixed rod guide has a piston 29 fixably formed thereupon.

A drive chamber 30 and a return chamber 32 are formed between the piston barrel 24 and the fixed rod guide 26 on alternate sides of the piston 29. Fluid pressure applied to the return chamber 32 biases the piston barrel 24 and the drill string 11 in a return direction 33. Fluid pressure applied to the drive chamber 30 biases the piston barrel 24 and the drill string 11 in a drive direction 31.

First conduit 34 and second conduit 36 are in fluid communication with return chamber 32 and drive chamber 30, respectively. The first conduit 34 is also in fluid communication with an overcenter valve 38 while second conduit 36 is also in fluid communication with port A of feed pump 40. A conduit 50 communicates port B of the feed pump 40 with the overcenter valve 38.

The feed pump 40 is a variable reversible displacement pump. This type of pump is well known in the art, and permits flow out of either port A or B, but not at the same time. The pressure limit of the feed pump 40 is controlled by feed pressure adjuster 42 which includes a conduit 44, a relief valve 46 and a reservoir 48.

The commercially available overcenter valve 38 includes normally closed valve 52 and spring biased check valve 54. The check valve 54 permits fluid passage from conduit 50 to the first conduit 34 when the pressure differential of the conduit 50 over the first conduit 34 exceeds a certain limit, and restricts fluid passage from the first conduit 34 to the conduit 50 at all times.

A variable spring 56 biases the normally closed valve 52 into its closed position. The elements which bias the normally closed valve into the open position are the fluid pressures contained in conduits 58 and 60. Conduit 58 is in fluid communication with the first conduit 34 while conduit 60 is in fluid communication with the second conduit 36. Note that the affects of pressure in the different conduits may be weighted differently as to how much influence they provide in the displacement of the normally closed valve. Operation characteristics of the overcenter valve are well known in the art.

The remainder of this section structurally compares the FIGS. 3, 5 and 8 embodiments with the FIG. 1 prior art embodiment.

The FIG. 3 embodiment differs from the FIG. 1 embodiment by the inclusion of a two way valve 62, conduits 64, 66, 68, 70 and 72, accumulator reservoir 74, orifice 76 and spring 78. These elements together define an adjustment means 80. The adjustment means 80 adjusts the setting of normally closed valve 52.

The two way valve 62 is displaceable between a two way position (in which fluid is permitted to pass in both directions between the accumulator reservoir 74 and the conduit 50, at the right in FIG. 3) and a one way position (in which fluid is permitted to pass from conduit 50 via conduits 64 and 72 to the accumulator reservoir 74, and not in the reversed direction). The one way position of the two way valve 62 is to the left in FIG. 3.

Fluid pressure applied to conduit 66 biases the two way valve 62 into the two way position. Fluid pressure in conduit 68 and the force exerted by spring 78 together bias the two way valve 62 into the one way position. When fluid is being pumped from port B of feed pump 40, the pressure is generally sufficient in conduit 66 to bias the two way valve into the two way position so the accumulator reservoir is exposed to whatever pressure is contained in conduit 50. When fluid is being pumped through port A of the feed pump 40 to second conduit 36 or the feed pump 40 is inactive, the pressure in conduit 68 and force from spring 78 typically combine to displace the two way valve 62 into the one way position.

Conduit 68 functions immediately following a rapid decrease of pressure applied to port B. As soon as pressure in conduit 66 drops below the pressure in conduit 68 (the two conduits 66 and 68 contain pressures from opposed sides of the check valve 54), the two way valve 62 is displaced into the one way position to maintain the pressure in the accumulator reservoir 74 constant.

Elements in the FIG. 5 embodiment which differ from the FIG. 1 embodiment includes pressure transducers 90, 92 and 94, controller 96, potentiometer 98, display 100, electro-hydraulic pressure controls 102, 104, constant displacement pump 106, reservoirs 108, 110, and conduits 112, 114, 116 and 118. All of the above members are included in an adjustment means 120.

Pressure transducer 90, 92 and 94 sense the pressure in the first conduit 34, the second conduit 36 and conduit 50, respectively. The signals from all of the pressure transducers 90, 92 and 94 are input to controller 96. A potentiometer 98, set by the operator to the desired drill feed force, is also input to the controller 96. The controller is preferably microprocessor based, but may also utilize any suitable computer based system.

Figure 6:
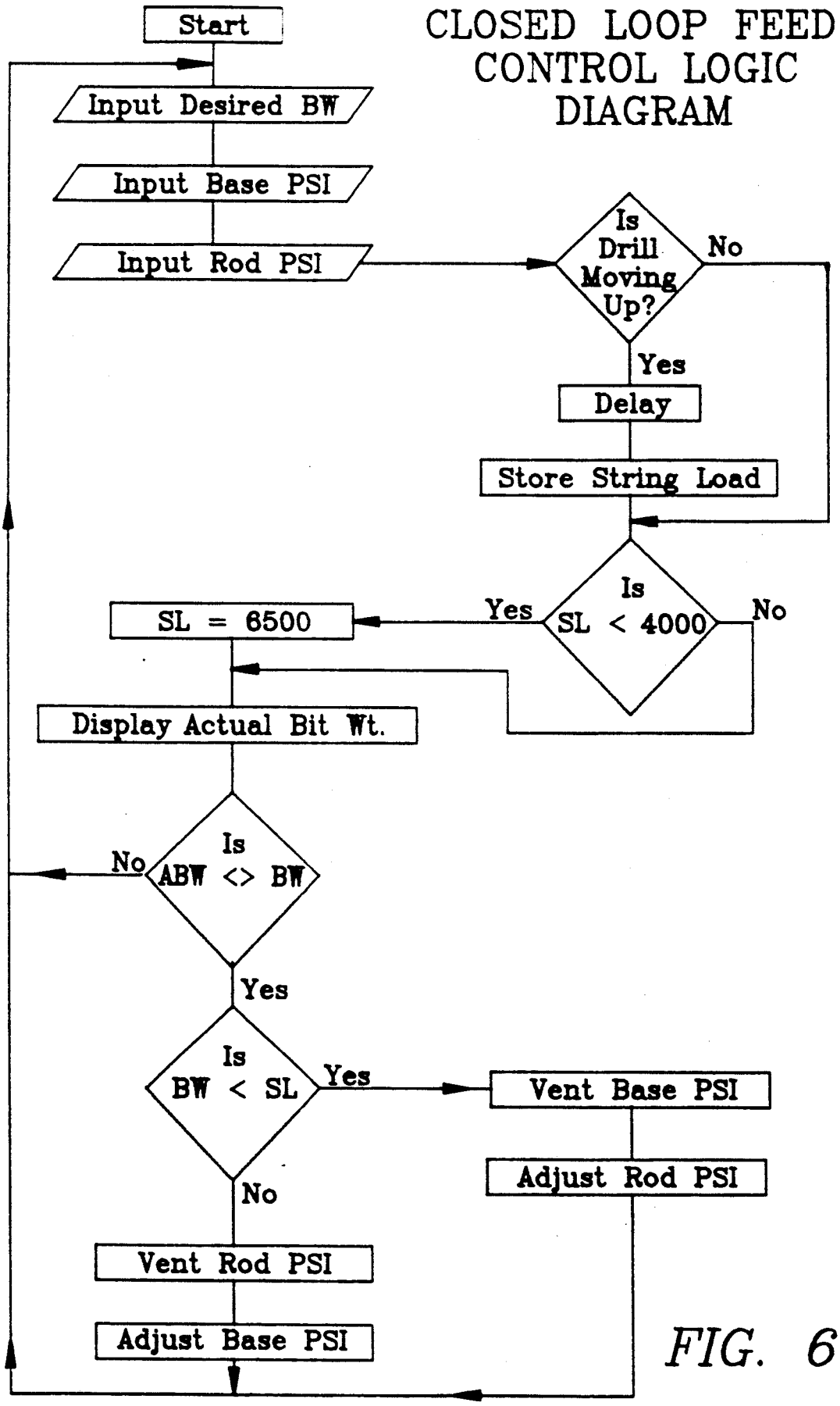
FIG. 6 is a logic diagram such as may be used in the controller illustrated in FIG. 5.

The controller follows a logic program similar to that illustrated in FIG. 6. Based upon the logic program, output signals from the controller are sent to the electro-hydraulic proportional pressure controls 102, 104 and the display 100. The proportional pressure controls 102 and 104 regulate the operation of the overcenter valve 38 and the feed pump 40, respectively, as described in the operation portion of the specification.

Proportional pressure control 102 applies an adjustable resistance to fluid exiting from conduit 112. Since constant displacement pump 106 pumps a fixed volume of fluid per specified time from reservoir 108 to conduits 114 and 112, adjustment of the above resistance will effectively control pressure in conduit 112. The pressure in conduit 112 applies a force, along with a force produced by variable spring 56, which maintain the normally closed valve 52 in the closed position as is known in the art.

Proportional pressure control 104 acts to regulate the fluid flow from conduit 118 to conduit 116. Feed pump 40 displaces some fluid under pressure to conduit 118. Altering the pressure in conduit 118 by regulating fluid flow from the proportional pressure control 104 will control the operation of the feed pump 40 as is well known in the pump art.

The FIG. 8 embodiment is identical to the FIG. 5 embodiment except that pressure transducer 94 is replaced by a pressure switch 122. The pressure switch is mechanically actuated each time the drill string 11 performs a predetermined step, such as travel of the feed cylinder 28 in the return direction. This actuation results from either manual action by the operator of the drilling apparatus or by physical contact of a portion of the drilling apparatus 10 with the pressure switch 122 which occurs during the desired portion of the return cycle.

Operation

The first portion of this section describes the general drilling process utilizing the FIG. 1 prior art embodiment. The latter portion of this section describes how motive force is provided for each of the systems illustrated in FIGS. 1,3, 5 and 8 in both the drive direction 31 and then the return direction 33.

Typically, drilling is performed as follows. Feed pump 40 exerts fluid flow through port A and second conduit 36 to extend the drill string in the drive direction 31 until the rotary head 12 is at its low point within the drilling apparatus 10. The drill string 11 is then secured to a drill string restraint (not shown) by devices well known in the art to vertically secure the drill string 11 when the rotary head 12 is uncoupled from the drill string 11. The rotary head 12 is then uncoupled from the drill string 11.

The feed pump is then switched to apply fluid pressure through port B to the conduit 50. The pressure in the conduit 50 increases to bias the spring biased check valve 54 open and applies pressure to the first conduit 34, driving the rotary head 12 and the piston barrel 24 in the return direction 33. After a sufficient distance has been covered by the rotary head 12, a new length of drill string 11 is affixed to the rotary head 12.

The new length of drill string is raised in the return direction 33 sufficiently to affix it to the remainder of the drill string. The feed pump is then shut off and the new length is attached to the remainder of the drill string 11. The rotary head 12 is then driven in the return direction 33 sufficiently to uncouple the drill string from the drill string restraint. The drill string is now in the proper position for drilling.

The feed pump 40 once again applies pressure through port A to the second conduit 36 to displace the rotary head 12, the drill string and the piston barrel 24 in the drive direction 31. The drill string will be able to drill as desired until the rotary head 12, once again, reaches its lowest position within the drilling apparatus. The cycle is then repeated as desired.

During portions of the above specified drilling operation, the rotary head 12 is being driven in the return direction 33 with no weight attached to it, with only one length of drill string attached to it and with the weight of the entire drill string attached to it. The weight of the entire drill string varies as other lengths of drill string are attached.

The remainder of the operation portion of this disclosure describes how each prior art and present invention configuration operates in both the return and the drive directions.

The FIG. 1 prior art embodiment acts to displace the drill string 11 in the return direction 33 as follows. Fluid pressure is applied from port B of the feed pump 40, increasing pressure in conduit 50. The pressure in conduit 50 is sufficient to bias the check valve 54 into the open position and thereby increase fluid pressure in the first conduit 34. The pressure in the first conduit 34 is applied to return chamber 32 which drives the piston barrel 24, the rotary head 12 and the drill string 11 in the return direction 33.

The operator personally determines the weight of the drill string 11 and the rotary head 12 to optimize operation of the drill and limit the force applied to the material being drilled. The operator sets the variable spring 56 or the relief valve 46 based upon the determined weight. In the present invention, it is not necessary to determine this weight to provide optimum performance.

Figure 2:
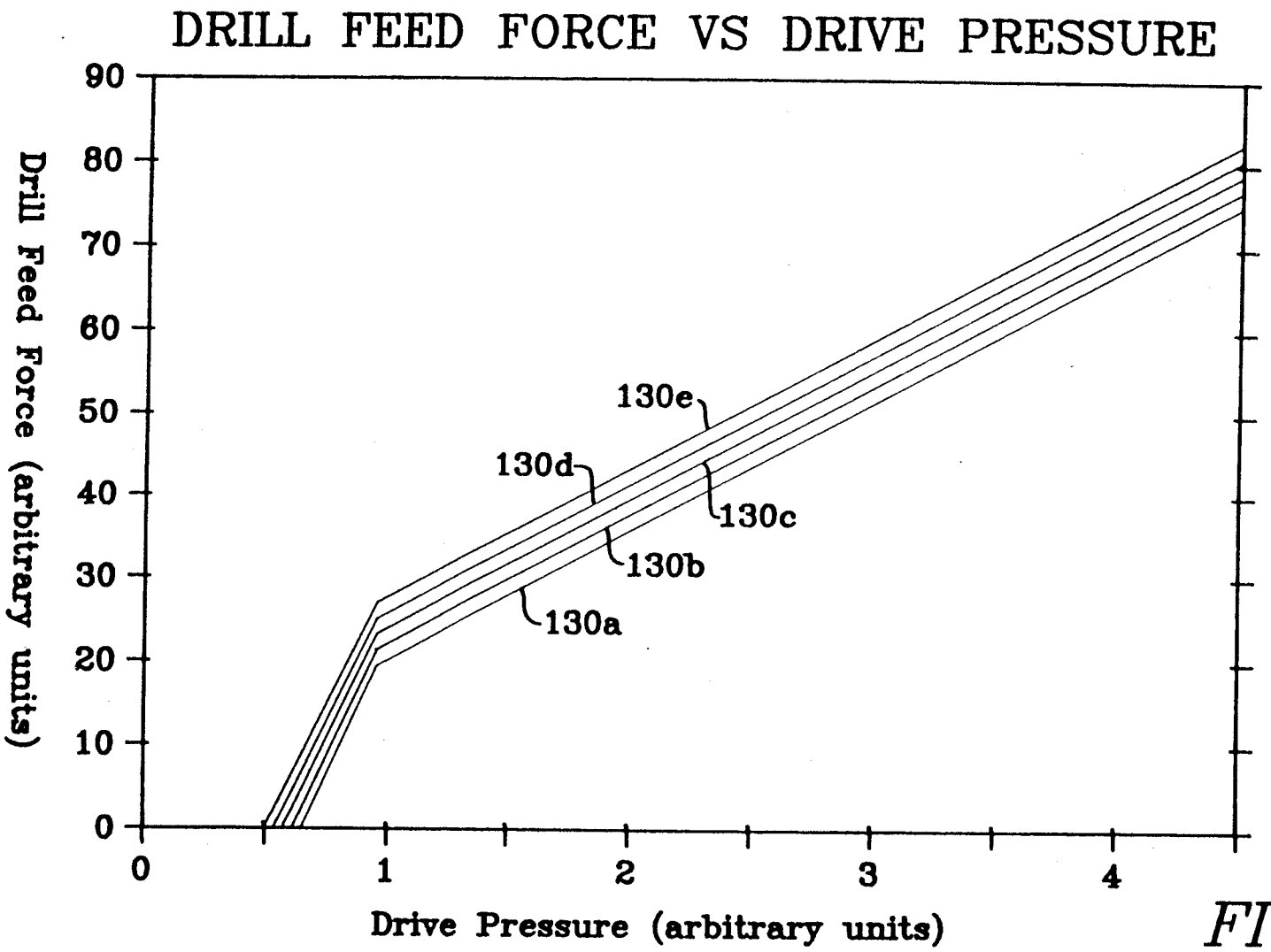
FIG. 2 is graph illustrating one example of drill feed force vs drive pressures of a drilling system using the drill feed control of FIG. 1.

Often the operator sacrifices optimization of the drilling process for the convenience of not setting the variable spring 56 or the relief valve 46 after the weight of the drill string 11 is altered. The drill feed force vs drive pressure graph of FIG. 2 illustrates that, with a fixed setting of variable spring 56, different drive pressures are necessary to produce the same drill feed forces for drill strings of different weights (illustrated by graph plots 130 a,b,c,d and e).

To switch the drill string to the drive direction after the variable spring has been manually set, the operator manually selects an appropriate pump displacement that results in a discharge of fluid out of the feed pump from port A to the second conduit 36. The pump will automatically decrease its displacement of oil from port A to the extent necessary to maintain pressure in the second conduit at the level required by the setting of the relief valve 46 of the feed pressure adjuster 42 (also selected by the operator). The pressure in the second conduit 36 enters the drive chamber 30 of the feed cylinder 28 and exerts a force on the piston 29.

Pressure in the second conduit 36 also enters conduit 60 and acts upon the normally closed valve 52 to influence its opening. Movement of the piston 29 produces a pressure increase in the return chamber 32 which causes movement of the fluid out of the return chamber 32 to the first conduit 34 and into conduit 58 where this pressure will, in combination with the pressure in conduit 60, bias normally closed valve 52 open. The pressure in the first conduit 34 will increase to resist movement of the piston 29 until sufficient pressure is generated in conduits 58 and 60 to override the force of the spring 56 and open the valve 52.

If the variable spring 56 is set correctly, then virtually all of the pressure exerted from port A of feed pump 40, when the drill string is being driven in the drive direction, will be used to drive the drill string and not overcome excess holdback pressure as set with the variable spring 56.

Since the variable spring 56 is typically not set after each cycle, a situation as illustrated in the FIG. 2 graph occurs. Graph plot 130 a represents a plot of drill feed force vs. drive pressure when a relatively light drill string is used. Graph plots 130 b,c,d, and e represent the same plot with a plurality of progressively heavier drill string 11 weights being used when the setting of the variable spring 56 is maintained at a constant setting.

The FIGS. 3, 5 and 8 present invention embodiment operate similarly to the FIG. 1 prior art embodiment except that the setting of the overcenter valve 38 occurs automatically. The present invention permits a uniform pressure from the feed pump port A through second conduit 36 to displace the feed cylinder 28 and the rotary head 12 in the drive direction 31 with a constant force regardless of how much the drill string 11 weighs. This is accomplished by automatically biasing the overcenter valve 38 (which acts as a counterbalance when the drill string is being displaced in the drive direction 31) to the weight which is affixed to the rotary head 12, plus the weight of the rotary head, each time the rotary head is displaced in the return direction 33.

When the drill string is being displaced in the return direction 33, fluid pressure is being exerted from port B of feed pump 40 as previously described for FIG. 1. In FIG. 3, pressure from port B is in immediate communication with conduits 50, 64 and 66. The pressure in conduit 66 biases the two way valve 62 into the two way position, whereupon the pressure in the accumulator reservoir duplicates that in conduit 50.

The pressure in conduit 68 also closely follows that in conduit 50 whenever the check valve 54 is biased open. The pressure in conduit 68 is maintained after a sudden pressure drop in conduits 50 and 66 since the check valve 54 will be biased closed. The two way valve 62 is then biased into the one way position. This ensures that the pressure in accumulator 74 reflects the constant pressure applied to conduit 50 when the feed pump last pumped fluid from port B.

Displacement of the FIG. 3 drill string 11 in the drive direction is accomplished when the operator selects an appropriate position of the pump displacement control (not shown). When fluid pressure is exerted from port A or no pressure is being supplied from either port A or port B, the pressure in the accumulator reservoir 74 is maintained at the last pressure contained in conduit 50 when fluid pressure was being supplied through port B of the feed pump. The normally closed valve 52 maintains the fluid contained within the first conduit 34.

Figure 4:
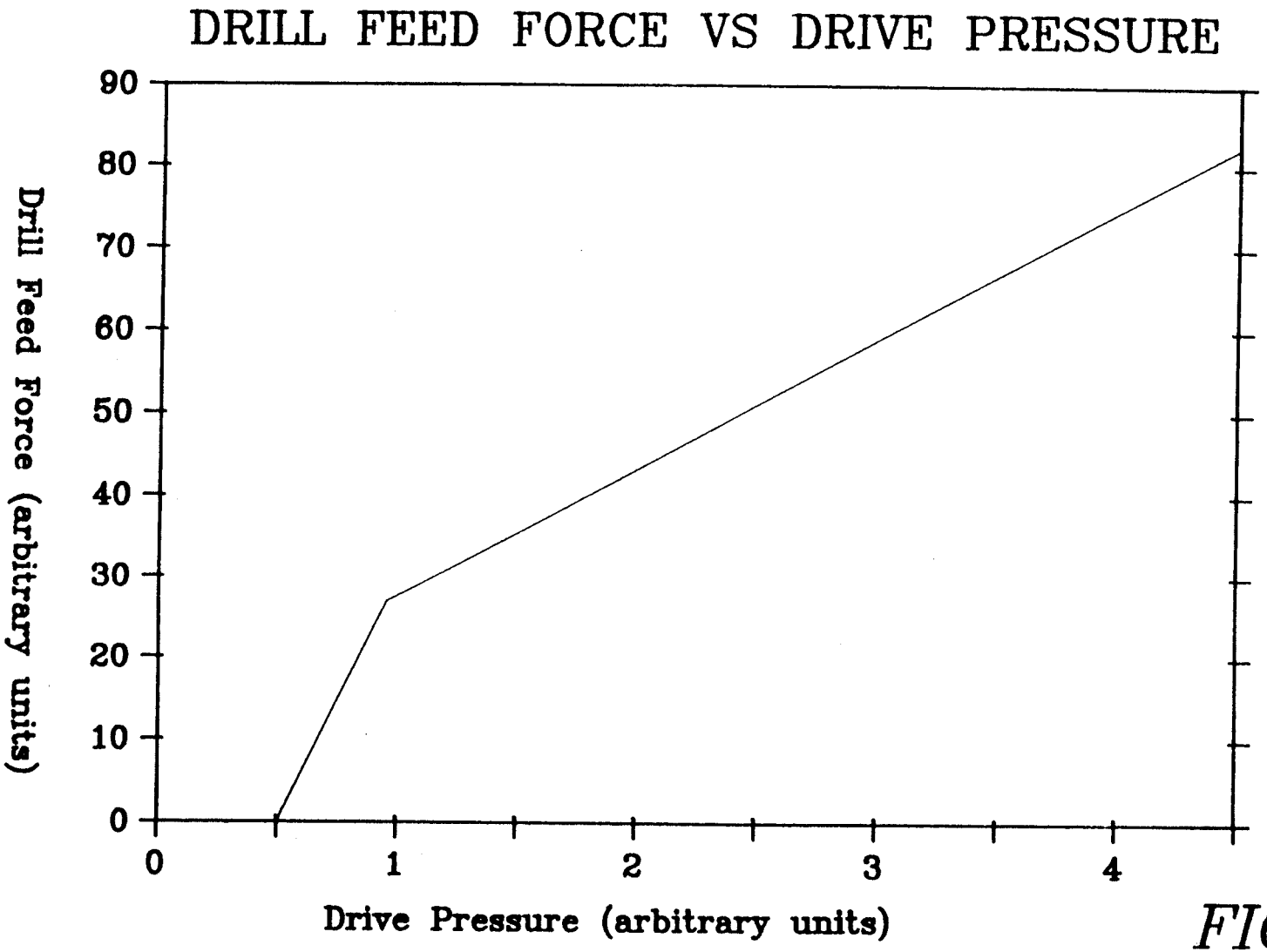
FIG. 4 is graph illustrating one example of drill feed force vs drive pressures of a drilling system using the drill feed control of FIG. 3.

Since the setting of the FIG. 3 overcenter valve 38 is accurately adjusted on the drive stroke based upon the force last required to lift the drill string 11 in the return direction 33 (and controlled accordingly), the graph of drill feed force vs. drive pressure will appear as in FIG. 4, regardless of the weight of the drill string.

The drilling apparatus illustrated in FIGS. 5 and 8 operate similarly to the FIG. 3 embodiment, but utilize different elements. The FIG. 5 embodiment operates in this manner. The pressure in the first conduit 34, the second conduit 36 and the conduit 50 are continually monitored utilizing pressure transducers 90, 92 and 94 respectively. The signals from all three pressure transducers are continually supplied to controller 96.

The FIG. 5 embodiment operates in the return direction in the following manner. After fluid is expelled from port B of the feed pump 40 through conduit 50, first conduit 34 and into the return chamber 32, the feed cylinder begins its displacement initially in the return direction. Fluid pressure in the first conduit 34 drops to a lower level than in the conduit 50 as flow is established across check valve 54. At this point, the controller 96 recognizes that the drill string is starting to be displaced in the return direction 33 and the string weight can be computed using the equation:

$$\text{String Weight} = [(PR \times Area) - (PD \times Area)/2]$$

PR = pressure in the return chamber 32.
PD = pressure in the drive chamber 30.
Area = internal area of feed cylinder 28.
2 is a factor representing the 2 to 1 mechanical advantage of the mechanical feed system represented.

The value of string weight is then used by the controller 96 to calculate the actual drill feed force using the following equation:

$$\text{Feed Force} = (PD \times A - PR \times A)/2 + \text{String Weight} + K$$

The drill feed force is the actual weight applied to the rock by the drill device and K is the force value representing hydraulic and mechanical losses in the feed system. When the pressure in the first conduit 34 suddenly increases above that in conduit 50, the controller recognizes that the feed pump 40 is no longer applying fluid pressure from port B. The last value of string weight, from memory, is stored throughout the duration when the drill string is being displaced in the drive direction 31 or is stationary.

The value for the string weight is stored in the memory of the controller 96 until another lift cycle is initiated. The signal is used to set the bias value of the overcenter valve 38 and the feed pump 40, as described below. The drive direction 31 operation of the FIG. 5 embodiment is identical to that of the FIG. 3 embodiment.

Signal Utilization

The controller 96 of FIG. 5 regulates the feed pump 40 and the overcenter valve 38 in the following manner. The electro-hydraulic proportional pressure control 104 is inserted between a reservoir 110 and the feed pump 40 and is controlled by the controller 96. The pressure control 104 limits the pressure in the pump internal pressure compensator by regulating pressure in conduit 118. The feed pump 40 provides the fluid for creating pressure in conduit 118 by providing a small steady flow into conduit 118

Movement of the pumps displacement control (not shown) in alternate directions from the neutral position results in appropriate flow from port A or port B of the feed pump 40. Regulation of pressure in conduit 118 regulates what pressure the fluid is expelled under. Controls of feed pumps 40 of this type are well known in the art, and will not be described in greater detail here.

The controller 96 controls the overcenter valve 38 in the following manner. The continually operating constant displacement pump 106 (which operates to a maximum pressure) supplies fluid to conduit 112 via conduit 114 at a constant rate. The electro-hydraulic proportional pressure control 102 regulates fluid flow from the conduit 112, and thereby controls pressure in conduit 112. Increased pressure in the conduit 112 progressively biases the overcenter valve 38 closed.

When the electro-hydraulic proportional pressure control 102 is open, fluid in conduit 112 will escape to reservoir 110 prior to adequate pressure build up to contribute to overcenter valve closing bias.

FIG. 6 represents a flowchart of the logic which the controller 96 follows in deriving the output signal to be supplied to proportional pressure controls 102 and 104. The desired drill feed force value input by the operator, by setting of the potentiometer 98, is compared to the actual value determined by the above equation, and an error signal is produced quantifying the difference between the two values. The controller then continually corrects the error by changing signals applied to hydraulic—electric pressure controls 102 and 104.

Figure 7:
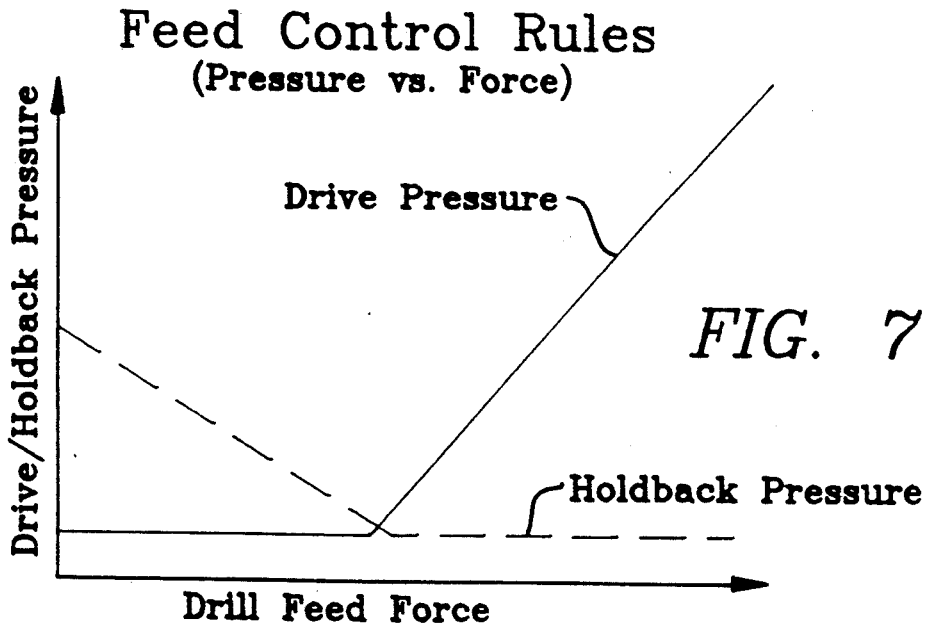
FIG. 7 is a graphic representation of drive pressure and holdback pressure vs. drill feed force for the controllers of the FIGS. 5 and 8 embodiments.

FIG. 7 represents a graph of feed force vs. drive/-holdback pressure as regulated by a controller following the FIG. 6 flowchart. As long as there is enough string weight to meet the drill feed force requirement selected by the operator, the drive pressure is held to a low value and the holdback pressure is adjusted as required to satisfy the force requirement. When the desired feed force exceeds the available string weight, the additional drill feed force needed is provided by increasing the drive pressure.

FIG. 7 is intended only as an example of a feed force vs. feed pressure graph which may be obtained. It is worth noting that the graph having a different outline may be obtained by programming into the controller 96 a desired pressure profile.

The FIG. 8 embodiment performs similarly to the FIG. 5 embodiment except that motion of the drill string in the return direction is recognized by actuation of the pressure switch 122. The FIG. 5 embodiment, by comparison, utilizes the relative pressures in the first conduit 34 and the conduit 50 to determine which direction the feed pump 40 is displacing the drill string 11.

The FIG. 8 embodiment, by comparison, utilizes actual displacement of the feed cylinder 28, the drill string 11, manual control by the operator or some other physical displacement input to pressure switch 122 to signal when the drill string is being displaced in the return direction 32. At this point, the controller stores the input from the pressure transducers 90 and 92 to determine the return force as described above.

While this invention has been illustrated and described in accordance with a preferred embodiment, it is recognized that other variations and changes may be made therein without departing from the invention as set forth in the claims.

Having described the invention, what is claimed is:

1. An apparatus comprising:

a feed cylinder having a first end port and a second end port, the feed cylinder movable in a drive direction in response to fluid pressure applied to the first end port and movable in a return direction in response to fluid pressure applied to the second end port;

feed pump means for alternatively applying fluid pressure to the first or the second end ports;

variable overcenter means for controlling relative fluid pressure between the second end port and the feed pump means during application of fluid pressure by the feed pump means to the first end port; and adjustment means for automatically adjusting the variable overcenter means during each application of fluid pressure to the first end port to cause said overcenter means to be operative in response to a fluid pressure corresponding to the fluid pressure last applied to the second end port.

2. The apparatus as described in claim 1, wherein the adjustment means includes a controller.

3. The apparatus as described in claim 2, wherein the controller senses pressure in communication with the second end port, and controls said adjustment means according to the sensed pressure.

4. The apparatus as described in claim 1, wherein the adjustment means includes a pressure reservoir which is in communication with the second end port, wherein the pressure in the pressure reservoir is in communication with said variable overcenter means.

5. The apparatus as described in claim 1, wherein the adjustment means is actuated by fluid pressure.

6. The apparatus as described in claim 1, wherein the adjustment means is actuated by an electronic signal.

7. The apparatus as described in claim 1, wherein the adjustment means is regulated by a quantity of an electric signal.

* * * * *